US005506019A

United States Patent [19]

Abeyta et al.

[11] Patent Number: 5,506,019

[45] Date of Patent: Apr. 9, 1996

[54] TABLE COVER AND METHOD OF MAKING SAME

[76] Inventors: Joseph T. Abeyta; Anna A. Abeyta, both of 8787 W. Cornell Ave., Unit 19-#4, Lakewood, Colo. 80227

[21] Appl. No.: 314,681

[22] Filed: Sep. 29, 1994

[51] Int. Cl.[6] ..... A47G 11/00; B32B 3/04

[52] U.S. Cl. ..... 428/57; 5/482; 5/487; 5/493; 5/495; 108/90; 108/165; 150/150; 297/228.11; 297/229; 428/124; 428/192; 428/224; 428/906; D6/617

[58] Field of Search ..... 428/57, 124, 192, 428/224, 35.2, 30.1, 906; 108/90, 165; 297/228.11, 229; 5/487, 493, 495, 482; 150/150; D6/617

[56] References Cited

U.S. PATENT DOCUMENTS

| | | | |
|---|---|---|---|
| 1,332,776 | 3/1920 | Sultanaki | 108/90 |
| 2,720,248 | 10/1955 | Kipnis | 154/42 |
| 2,809,466 | 10/1957 | Glover | 108/90 |
| 3,059,209 | 10/1962 | Bird | 339/75 |
| 3,368,601 | 2/1968 | Gantert-Merz | 108/90 |
| 3,785,419 | 1/1974 | Sherlock | 108/90 |
| 4,146,419 | 3/1979 | Neidhart | 156/391 |
| 4,358,865 | 11/1982 | Pagel | 5/487 |
| 4,445,955 | 5/1984 | Struve | 156/153 |
| 4,695,005 | 9/1987 | Gietman, Jr. | 242/56 R |
| 4,715,915 | 12/1987 | Vanderzee | 156/182 |
| 4,737,212 | 4/1988 | Emrich et al. | 156/157 |
| 5,051,148 | 9/1991 | Resch | 156/358 |
| 5,211,288 | 5/1993 | Beall | 206/577 |
| 5,284,099 | 2/1994 | Cohen | 108/90 |

FOREIGN PATENT DOCUMENTS

| | | |
|---|---|---|
| 3184510 | 8/1991 | Japan . |

*Primary Examiner*—Nasser Ahmad

[57] ABSTRACT

A table cover for covering a top surface and open side areas of a table. The inventive device includes a top cover web having opposed top cover longitudinal edges thereof placable over the top surface of an associated table structure. A first side drape web is coupled to a first edge of the top cover so as to hang downwardly therefrom to cover a first open side area of the table. A second side drape web is similarly coupled to a second edge of the top cover to hang downwardly therefrom to cover a second open side area of the table. The table cover is formed by a process resulting in an inherent placement of the table cover in a folded condition for rolling into a supply roll, whereby a suitable length of the table cover can be dispensed from the roll and cut to fit a particular length of the associated table. The table cover is preferably formed of contrastingly colored webs and may additionally include a valance extending along a juncture of the first side web and the top cover web.

15 Claims, 3 Drawing Sheets

10
24
12
18
22
28
36
32
34

38
10
32

24
40
42
12
4
38
44
18
36
4
24
32
10

TABLE COVER AND METHOD OF MAKING SAME

BACKGROUND OF THE INVENTION

1. Field of the Invention

The present invention relates to covering devices and more particularly pertains to a table cover for covering a top surface and open side areas of a table.

2. Description of the Prior Art

Elongated and rectangular table structures are often utilized during events to support items such as food and the like. Typically, these tables are covered with a table cloth or other covering device which must be prefabricated for fitting to a particular table. It is common for catering crews or other service personnel to supply the table coverings, while the tables are already present at the banquet hall. Thus, it is necessary for the service personnel to carry many different styles and lengths of prefabricated table coverings to the event to accommodate the various sized tables present. Further, it is often desirable to place a plurality of tables in an end-to-end fashion to form elongated table assemblies, with the prior art offering no appropriately configured covering device for customized covering of such table assemblies.

Therefore, it can be appreciated that there exists a continuing need for a new table cover which can be custom fitted to any table length as desired. In this regard, the present invention substantially fulfills this need.

SUMMARY OF THE INVENTION

In view of the foregoing disadvantages inherent in the known types of covering devices now present in the prior art, the present invention provides a new table cover construction wherein the same can be utilized for covering a top surface and open side areas of a table. As such, the general purpose of the present invention, which will be described subsequently in greater detail, is to provide a new table cover apparatus and method which has many of the advantages of the covering devices mentioned heretofore and many novel features that result in a table cover which is not anticipated, rendered obvious, suggested, or even implied by any of the prior art covering devices, either alone or in any combination thereof.

To attain this, the present invention generally comprises a table cover for covering a top surface and open side areas of a table. The inventive device includes a top cover web having opposed top cover longitudinal edges thereof placable over the top surface of an associated table structure. A first side drape web is coupled to a first edge of the top cover so as to hang downwardly therefrom to cover a first open side area of the table. A second side drape web is similarly coupled to a second edge of the top cover to hang downwardly therefrom to cover a second open side area of the table. The table cover is formed by a process resulting in an inherent placement of the table cover in a folded condition for rolling into a supply roll, whereby a suitable length of the table cover can be dispensed from the roll and cut to fit a particular length of the associated table. The table cover is preferably formed of contrastingly colored webs and may additionally include a valance extending along a juncture of the first side web and the top cover web.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new table cover apparatus and method which has many of the advantages of the covering devices mentioned heretofore and many novel features that result in a table cover which is not anticipated, rendered obvious, suggested, or even implied by any of the prior art covering devices, either alone or in any combination thereof.

It is another object of the present invention to provide a new table cover which may be easily and efficiently manufactured and marketed.

It is a further object of the present invention to provide a new table cover which is of a durable and reliable construction.

An even further object of the present invention is to provide a new table cover which is susceptible of a low cost of manufacture with regard to both materials and labor, and which accordingly is then susceptible of low prices of sale to the consuming public, thereby making such table covers economically available to the buying public.

Still yet another object of the present invention is to provide a new table cover which provides in the apparatuses and methods of the prior art some of the advantages thereof, while simultaneously overcoming some of the disadvantages normally associated therewith.

Still another object of the present invention is to provide a new table cover for covering a top surface and open side areas of a table.

Yet another object of the present invention is to provide a new table cover which includes a top cover web having opposed top cover longitudinal edges thereof placable over the top surface of an associated table structure, a first side drape web coupled to a first edge of the top cover so as to hang downwardly therefrom to cover a first open side area of the table, and second side drape web is similarly coupled to a second edge of the top cover to hang downwardly therefrom to cover a second open side area of the table.

Even still another object of the present invention is to provide a new table cover which is formed by a process resulting in an inherent placement of the table cover in a folded condition for rolling into a supply roll, whereby a suitable length of the table cover can be dispensed from the roll and cut to fit a particular length of the associated table.

Even still yet another object of the present invention is to provide a new table cover formed of contrastingly colored webs which may additionally include a valance extending along a juncture of the first side web and the top cover web.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
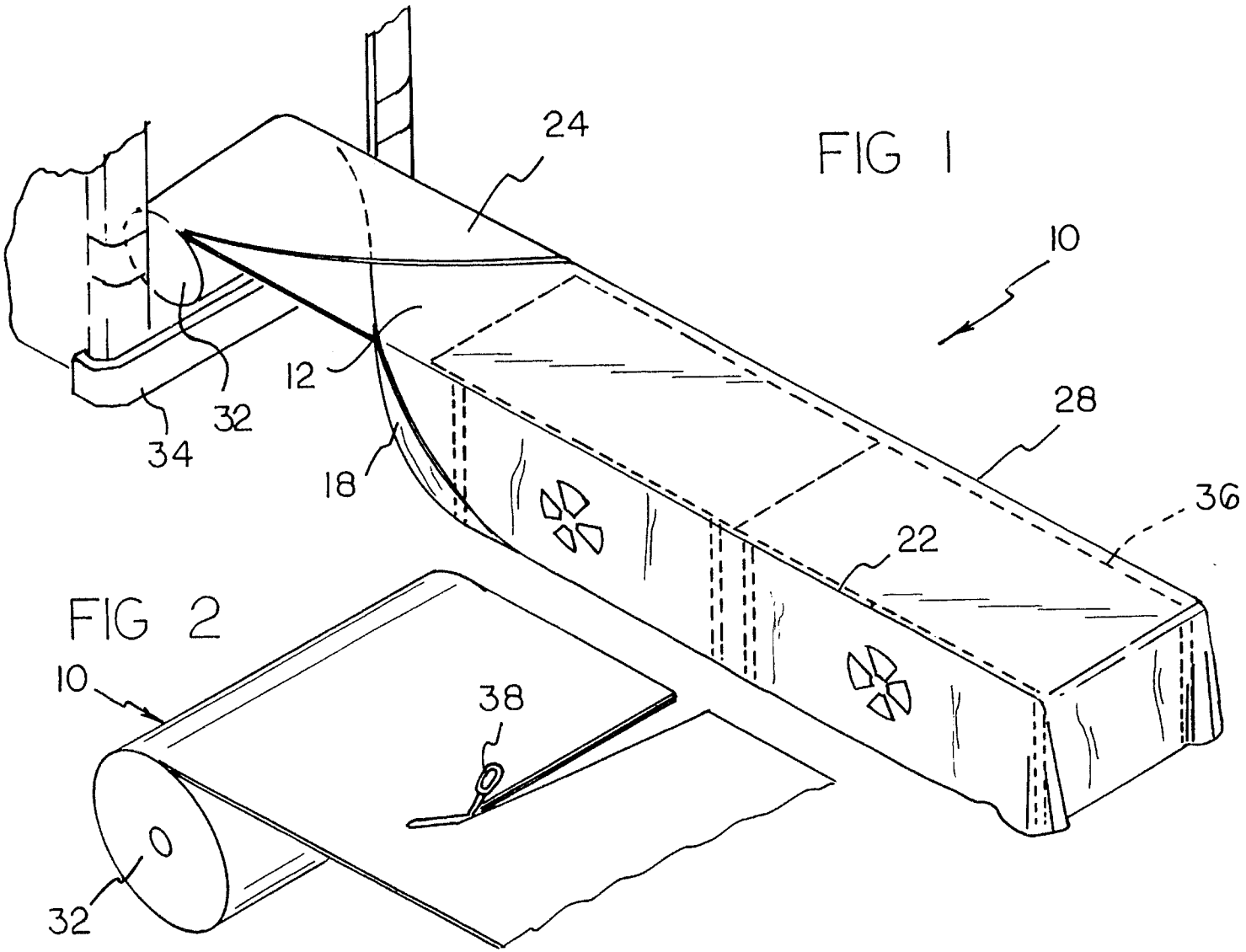
FIG. 1 is an isometric illustration of a table cover according to the present invention in use.
FIG. 2 is an isometric illustration of the table cover stored about a roll and being cut to size by a cutting means.

With reference now to the drawings, and in particular to FIGS. 1–5 thereof, a new table cover embodying the principles and concepts of the present invention and generally designated by the reference numeral 10 will be described.

Figure 4:
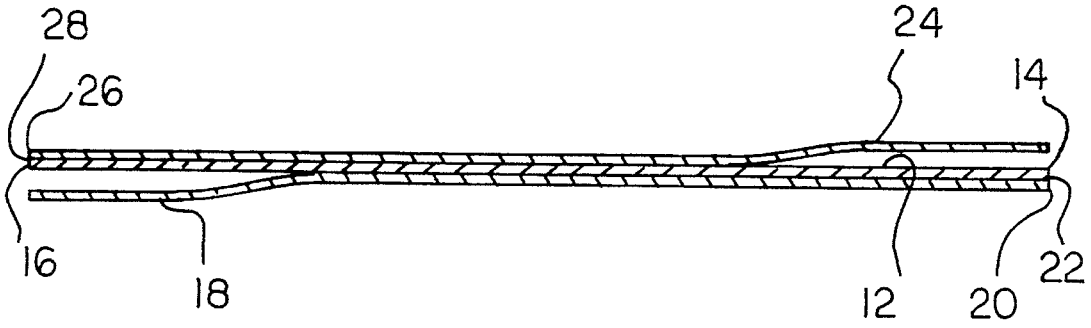
FIG. 4 is a cross sectional view taken along line 4—4 of FIG. 3.
Figure 5:
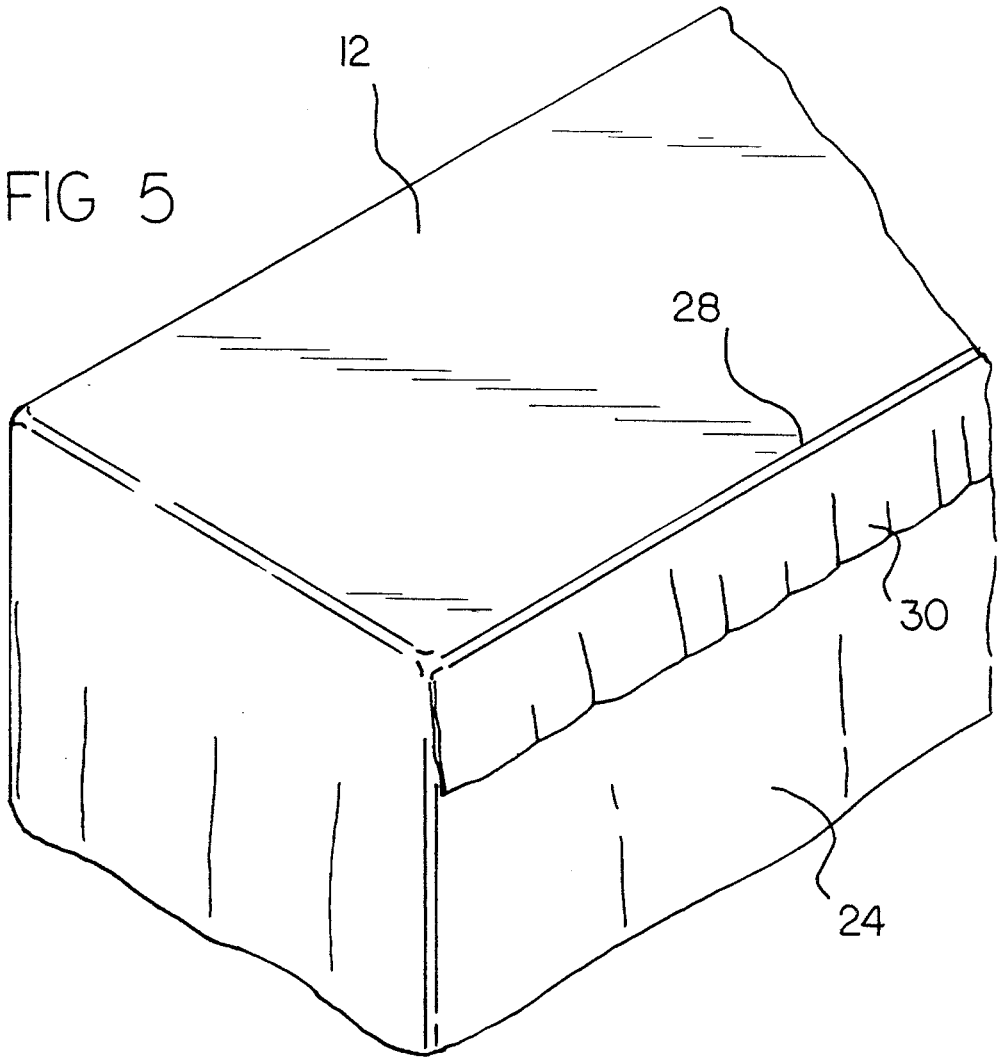
FIG. 5 is an isometric illustration of the table cover including a valance.

More specifically, it will be noted that the table cover 10 comprises a top cover web 12 having a first longitudinal edge 14 spaced from and parallel to a second longitudinal edge 16, as best illustrated in FIG. 4 of the drawings. A first side drape web 18 having opposed longitudinal edges is coupled at an upper longitudinal edge 20 thereof to the first longitudinal edge 14 of the top cover web 12 by a first longitudinal seam 22. Similarly, a second side drape web 24 having opposed longitudinal edges is coupled at an upper longitudinal edge 26 thereof to the second longitudinal edge 16 of the top cover web 12 by a second longitudinal seam 28. The longitudinal seams 22 and 28 can be formed by stitching or other mechanical fastening means, but are preferably formed by a heat melted joining of the webs 12, 18, and 24 together. To this end, the webs 12, 18, and 24 are preferably formed of a polymeric material, such as a polyethylene film of approximately 1.5 mils, which can be suitable heat melted to form the longitudinal seams 22 and 28. As shown in FIG. 5, the present invention 10 may additionally include a valance 30 secured to either of the longitudinal edges 14 and 16 of the top cover web 12 as a part of the respective longitudinal seam 22 or 28 to hang downwardly therefrom. The valance is preferably also constructed of a similar polymeric film as the webs 12, 18, and 24 and may be of a contrasting color relative to the webs.

Subsequent to construction of the present invention 10, the table cover can be rolled into a roll 32 as illustrated in FIG. 2, wherein the first side drape web 18 is positioned flatly against a bottom surface of the top cover web 12 with the second side drape web 24 being positioned flatly against a top surface of the top cover web. In this configuration, the table cover 10 is reduced to a width equal to at least a width of the top cover web. Further folding of the present invention 10 can also be accomplished prior to rolling of the table cover to further reduce the transverse width of the roll 32.

In use, the roll 32 of the table covering 10 can be rotatably mounted to a supporting structure, such as within the rear of a vehicle 34 as shown in FIG. 1. The table cover 10 can then be dispensed from the roll 32 by a manual pulling of the webs 12, 18, and 24 therefrom, and subsequently positioned onto an associated table 36. The webs 12, 18, and 24 can then be cut to a desired length by a cutting means 38, as shown in FIG. 2, so as to hang over the ends of the table 36. If desired, an unillustrated rectangular portion of the side drape webs proximal to longitudinal ends of the top cover web can be removed, whereby the remaining extended portion of the top cover web can be joined to the remaining open vertical edge of the side drape webs by a portable seam forming means such as a heated iron or the like. Such customized configuration of the present invention 10 positions the table cover 10 into a box like configuration extending about the ends of the table or tables 36.

Figure 3:
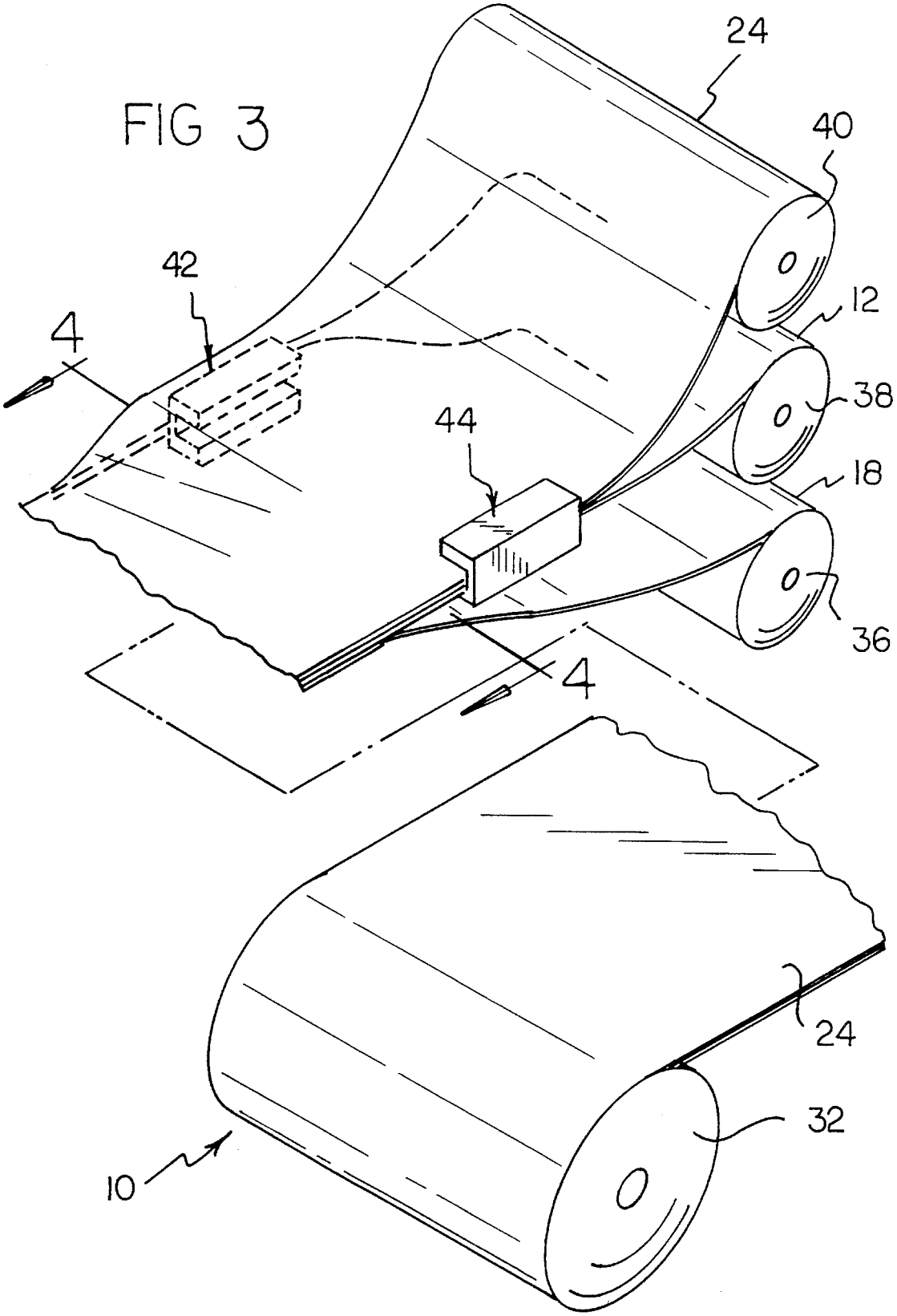
FIG. 3 is an isometric view illustrating a process for manufacturing the table cover.

FIG. 3 illustrates the method of making the table cover 10. In accordance with this method, a first supply roll 36 of the first side drape web 18 is positioned below a second supply roll 38 of the top cover web 12 which is similarly positioned below a third supply roll 40 of the second side drape web 24. The webs 12, 18, and 24 are then fed from the supply rolls 36–40 so as to position the first drape web into an abutting relationship with the bottom surface of the top cover web, and the second side drape web into an abutting relationship with the top surface of the top cover web. A first seam forming means 42 extends into contact with the top cover web 12 and the first side drape web 18 to join the first longitudinal edge 14 of the top cover web to the upper longitudinal edge 20 of the first side drape web. Similarly, a second seam forming means 44 extends into contact with the top cover web 12 and the second side drape web 24 to join the second longitudinal edge 16 of the top cover web to the upper longitudinal edge 26 of the second side drape web. As previously stated, the seam forming means 42 and 44 can comprise a stitching machine or a mechanical fastening machine which joins the webs 12, 18, and 24 together. However, the webs are preferably comprised of a polymeric film permitting the seam forming means to comprise heat melting seam forming apparatus which elevates a temperature of the edges of the webs 12, 18, and 14 to beyond a melting point of the polymeric film, whereby a welding and subsequent cooling of the webs takes place. With the webs 12, 18, and 24 thusly joined and inherently positioned in the folded configuration illustrated, the table cover is then wound into the roll 32. By this method, the table cover 10 can be inexpensively manufactured and distributed in the folded configuration, whereby the device can be utilized as a disposable cover because of such low productions costs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and descried, and accordingly, all suitable modifications and equivalents may be resorted to, falling within the scope of the invention.

What is claimed as being new and desired to be protected by Letters Patent of the United States is as follows:

1. A table cover comprising:

a top cover web having opposed longitudinal edges;

a first side drape web having an upper longitudinal edge, said first side web being coupled at said upper longitudinal edge thereof to a first one of said longitudinal edges of said top cover web by a first longitudinal seam; and, a second side drape web having an upper longitudinal edge, said second side web being coupled at said upper longitudinal edge thereof to a second one of said longitudinal edges of said top cover web by a second longitudinal seam;

wherein said webs are positioned in a folded condition defined by said first drape web being positioned into an abutting relationship with a bottom surface of said top cover web, and said second side drape web being positioned into an abutting relationship with a top surface of said top cover web;

and further wherein said top cover web includes an inner surface and an outer surface, said first side drape web includes an inner surface, and said second side drape web includes an outer surface; and further wherein said inner surface of said top cover web and said inner surface of said first side drape web are joined together, with said outer surface of said top cover web and said outer surface of said second side drape web being joined together.

2. The table cover of claim 1, wherein said webs in said folded condition are wound into a roll.

3. The table cover of claim 2, wherein said webs are formed of a polymeric film with said longitudinal seams being formed by a heat melted joining of said webs together.

4. The table cover of claim 3, and further comprising a valance secured to one of said longitudinal edges of said top cover web.

5. The table cover of claim 4, wherein said side drape webs are formed of a contrasting color relative to a color of said top cover web.

6. The table cover of claim 5, wherein said valance is formed of a contrasting color relative to a color of said top cover web.

7. The table cover of claim 1, wherein said top cover web includes spaced transverse end edges, and further wherein no additional webs extend from said transverse end edges of said top cover web such that said transverse end edges define free ends of said top cover web.

8. A table cover comprising:

a top cover web having opposed longitudinal edges, an inner surface and an outer surface;

a first side drape web having an upper longitudinal edge and an inner surface, said first side web being positioned with said inner surface of said first side web in an abutting and substantially coextensive relationship with said inner surface of said top cover web forming a folded configuration, said first side web being coupled at said upper longitudinal edge thereof to a first one of said longitudinal edges of said top cover web by a first longitudinal seam; and, a second side drape web having an upper longitudinal edge and an outer surface, said second side web being positioned with said outer surface of said second side web in an abutting and substantially coextensive relationship with said outer surface of said top cover web forming a folded configuration, said second side web being coupled at said upper longitudinal edge thereof to a second one of said longitudinal edges of said top cover web by a second longitudinal seam.

9. The table cover of claim 8, wherein said inner surface of said top cover web and said inner surface of said first side drape web are joined together, with said outer surface of said top cover web and said outer surface of said second side drape web being joined together.

10. The table cover of claim 9, wherein said webs are wound into a roll.

11. The table cover of claim 10, wherein said webs are formed of a polymeric film with said longitudinal seams being formed by a heat melted joining of said webs together.

12. The table cover of claim 11, and further comprising a valance secured to one of said longitudinal edges of said top cover web.

13. The table cover of claim 12, wherein said side drape webs are formed of a contrasting color relative to a color of said top cover web.

14. The table cover of claim 13, wherein said valance is formed of a contrasting color relative to a color of said top cover web.

15. The table cover of claim 8, wherein said top cover web includes spaced transverse end edges, and further wherein no additional webs extend from said transverse end edges of said top cover web such that said transverse end edges define free ends of said top cover web.

* * * * *